US011473227B1

(12) United States Patent
Van Loon, III

(10) Patent No.: US 11,473,227 B1
(45) Date of Patent: Oct. 18, 2022

(54) LACROSSE MESH CONFIGURATION

(71) Applicant: James C. Van Loon, III, Chandler, AZ (US)

(72) Inventor: James C. Van Loon, III, Chandler, AZ (US)

( * ) Notice: Subject to any disclaimer, the term of this patent is extended or adjusted under 35 U.S.C. 154(b) by 311 days.

(21) Appl. No.: 16/895,511

(22) Filed: Jun. 8, 2020

Related U.S. Application Data

(63) Continuation-in-part of application No. 16/512,163, filed on Jul. 15, 2019, now abandoned, which is a continuation-in-part of application No. 15/462,852, filed on Mar. 18, 2017, now abandoned.

(60) Provisional application No. 62/310,101, filed on Mar. 18, 2016.

(51) Int. Cl.

| | |
|---|---|
| ***D04B 21/08*** | (2006.01) |
| ***D04B 1/18*** | (2006.01) |
| ***D04B 15/46*** | (2006.01) |
| ***D04B 15/50*** | (2006.01) |
| ***D04B 1/16*** | (2006.01) |

(52) U.S. Cl.
CPC ..... *D04B 21/08* (2013.01); *D04B 1/16* (2013.01); *D04B 1/18* (2013.01); *D04B 15/46* (2013.01); *D04B 15/50* (2013.01); *D10B 2331/04* (2013.01)

(58) Field of Classification Search
CPC ..... D04B 21/08; D04B 21/06; D04B 21/20; D04B 21/202; D04B 27/12
See application file for complete search history.

(56) References Cited

U.S. PATENT DOCUMENTS

| | | | | |
|---|---|---|---|---|
| 2,249,342 | A * | 7/1941 | Aull | D04B 21/12 66/195 |
| 27,283,339 | | 12/1955 | Elmhirst | |
| 3,200,619 | A * | 8/1965 | Frith, Jr. | D04B 21/10 66/195 |
| 3,242,699 | A * | 3/1966 | Momoi | D04B 21/10 66/193 |
| 3,581,353 | A | 6/1971 | Sonntag | |
| 4,201,433 | A | 5/1980 | Caldwell | |
| 5,091,996 | A | 3/1992 | Kirby | |
| 5,339,657 | A * | 8/1994 | McMurray | D04B 21/10 66/195 |
| 5,601,907 | A * | 2/1997 | Matsumoto | D04B 21/10 428/134 |
| 9,186,829 | B2 | 11/2015 | Burns | |
| 9,259,883 | B1 | 2/2016 | Morrow et al. | |
| 2008/0146387 | A1 * | 6/2008 | Gait | A63B 59/20 473/513 |

(Continued)

*Primary Examiner* — Danny Worrell
(74) *Attorney, Agent, or Firm* — Schmeiser, Olsen & Watts LLP

(57) ABSTRACT

A lacrosse mesh with elastic portions is provided. Elastic portions of the lacrosse mesh may be formed along one or more vertical paths along a length of the lacrosse mesh. In some embodiments, the vertical paths along the length of the mesh having elastic properties may be symmetrical about a center of the mesh, or in other embodiments may not be symmetrical. The invention includes lacrosse mesh and goalie lacrosse mesh. The lacrosse mesh may be displaced in response to receiving a thrown ball or by a ball during a throwing motion of a lacrosse stick with the lacrosse mesh with elastic portions coupled to the head of the lacrosse stick.

1 Claim, 12 Drawing Sheets

(56) References Cited

U.S. PATENT DOCUMENTS

| | | | | |
|---|---|---|---|---|
| 2008/0268987 | A1* | 10/2008 | Lignelli | A63B 59/20 473/513 |
| 2014/0106911 | A1* | 4/2014 | Burns | B29C 45/14065 264/229 |
| 2014/0356295 | A1 | 12/2014 | Gerardi | |
| 2015/0018135 | A1* | 1/2015 | Van Loon, III | A63B 59/20 473/513 |
| 2015/0335970 | A1* | 11/2015 | Van Loon, III | A63B 59/20 442/1 |
| 2016/0008688 | A1* | 1/2016 | Van Loon, III | D04H 3/05 28/143 |
| 2016/0101333 | A1* | 4/2016 | McCampbell | D04B 21/12 28/165 |
| 2017/0175309 | A1* | 6/2017 | Van Loon, III | A63B 59/20 |
| 2019/0009153 | A1* | 1/2019 | Morrow | D04B 1/22 |
| 2022/0023728 | A1* | 1/2022 | Gilroy | D04B 21/10 |

* cited by examiner

LACROSSE MESH CONFIGURATION

CROSS REFERENCE TO RELATED APPLICATION[S]

This application is continuation-in-part of U.S. patent application entitled "LACROSSE MESH CONFIGURATION," Ser. No. 15/512,163, filed Jul. 15, 2019, which is a continuation-in-part of U.S. patent application entitled, "LACROSSE MESH CONFIGURATION," Ser. No. 15/462,852, filed Mar. 18, 2017, which claims priority to U.S. Provisional Patent Application entitled "ELASTOMERIC LACROSSE MESH CONFIGURATION," Ser. No. 62/310,101, filed Mar. 18, 2016, the disclosure of which is hereby incorporated entirely herein by reference.

BACKGROUND OF THE INVENTION

Technical Field

This invention relates generally to lacrosse mesh and more particularly to lacrosse mesh with elastic portions and a method of using the same.

State of the Art

There are several types of lacrosse equipment needed in order to play the sport. The most important piece of equipment is the lacrosse mesh. The lacrosse mesh is strung onto the head of the lacrosse stick and allows the player to cradle, throw, pass, and catch the ball, as well as shoot the ball on goal. The mesh has generally been the same for years with little variation. Players are responsible, to form the pocket in the mesh in ways to improve the ball control and shooting ability during play. One key feature of lacrosse mesh strung onto a head of the lacrosse stick is the pocket. Players consistently work to achieve a desired type pocket compliment their playing ability, position, comfort level and the like.

SUMMARY OF THE INVENTION

The present invention relates to a lacrosse mesh with elastic portion(s). For example, and without limitation, the mesh may be formed with elastomeric yarn or other material with elastic properties along any portion of the lacrosse mesh along vertical paths for the length of the mesh. In some embodiments, the vertical paths along the length of the mesh having elastic portion(s) may be symmetrical about a center of the mesh, or in other embodiments may not be symmetrical. In some embodiments, elastic portions may be located in various regions of the lacrosse mesh, such as horizontally across the mesh, diagonally across the mesh and other orientations and locations of the lacrosse mesh An embodiment of the invention includes a method of using a lacrosse mesh with elastic portions strung to a lacrosse head, the method comprising: receiving a thrown ball within the lacrosse mesh in an original state; displacing the lacrosse mesh in response to receiving the ball within the lacrosse mesh, wherein displacing the lacrosse mesh includes expanding the lacrosse mesh; returning the lacrosse mesh to an original state; and retaining the ball within the lacrosse mesh.

Another embodiment of the invention includes a method of using a lacrosse mesh with elastic portions strung to a lacrosse head, the method comprising: moving a lacrosse stick having a lacrosse head with the lacrosse mesh coupled to it in response to performing a throwing motion with the lacrosse stick, wherein a ball is within the lacrosse mesh in an original state; displacing the lacrosse mesh in response to performing the throwing motion, wherein displacing the lacrosse mesh includes expanding the lacrosse mesh; returning the lacrosse mesh to the original state in a wake of the ball traversing a length of the lacrosse mesh; and throwing the ball in response to moving the lacrosse head and returning the lacrosse mesh to the original state in the wake of the ball traversing the length of the lacrosse mesh, wherein the ball is thrown with greater velocity than a velocity created from a conventional lacrosse mesh with the same throwing motion.

Another embodiment includes a method of using a lacrosse mesh with elastic portions strung to a lacrosse head, the method comprising: receiving a thrown ball within the lacrosse mesh in an original state; displacing the lacrosse mesh in response to receiving the ball within the lacrosse mesh, wherein displacing the lacrosse mesh includes expanding the lacrosse mesh at the point of entry of the ball within the lacrosse mesh to form a pocket at the point of entry; returning the lacrosse mesh to an original state; retaining the ball within the lacrosse mesh; moving a lacrosse stick having a lacrosse head with the lacrosse mesh coupled to it in response to performing a throwing motion with the lacrosse stick, wherein a ball is within the lacrosse mesh in an original state; displacing the lacrosse mesh in response to performing the throwing motion, wherein displacing the lacrosse mesh includes expanding the lacrosse mesh; returning the lacrosse mesh to the original state in a wake of the ball traversing a length of the lacrosse mesh; minimizing whip, increasing hold and improving throwing control in response to returning the lacrosse mesh to the original state in the wake of the ball traversing the length of the lacrosse mesh; and throwing the ball in response to moving the lacrosse head and returning the lacrosse mesh to the original state in the wake of the ball traversing the length of the lacrosse mesh, wherein the ball is thrown with greater velocity than a velocity created from a conventional lacrosse mesh with the same throwing motion.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
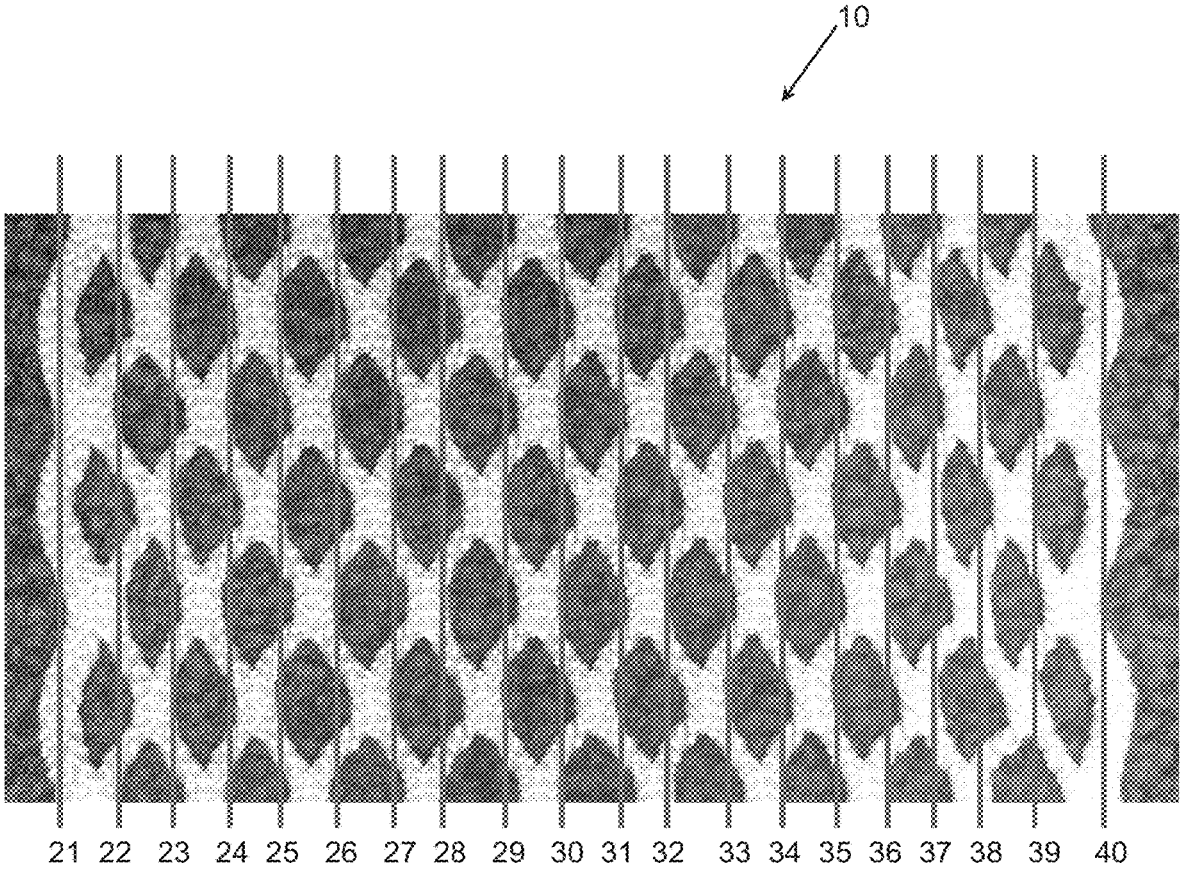
FIG. 1 is a view of lacrosse mesh with elastic portion(s), according to an embodiment.
Figure 2:
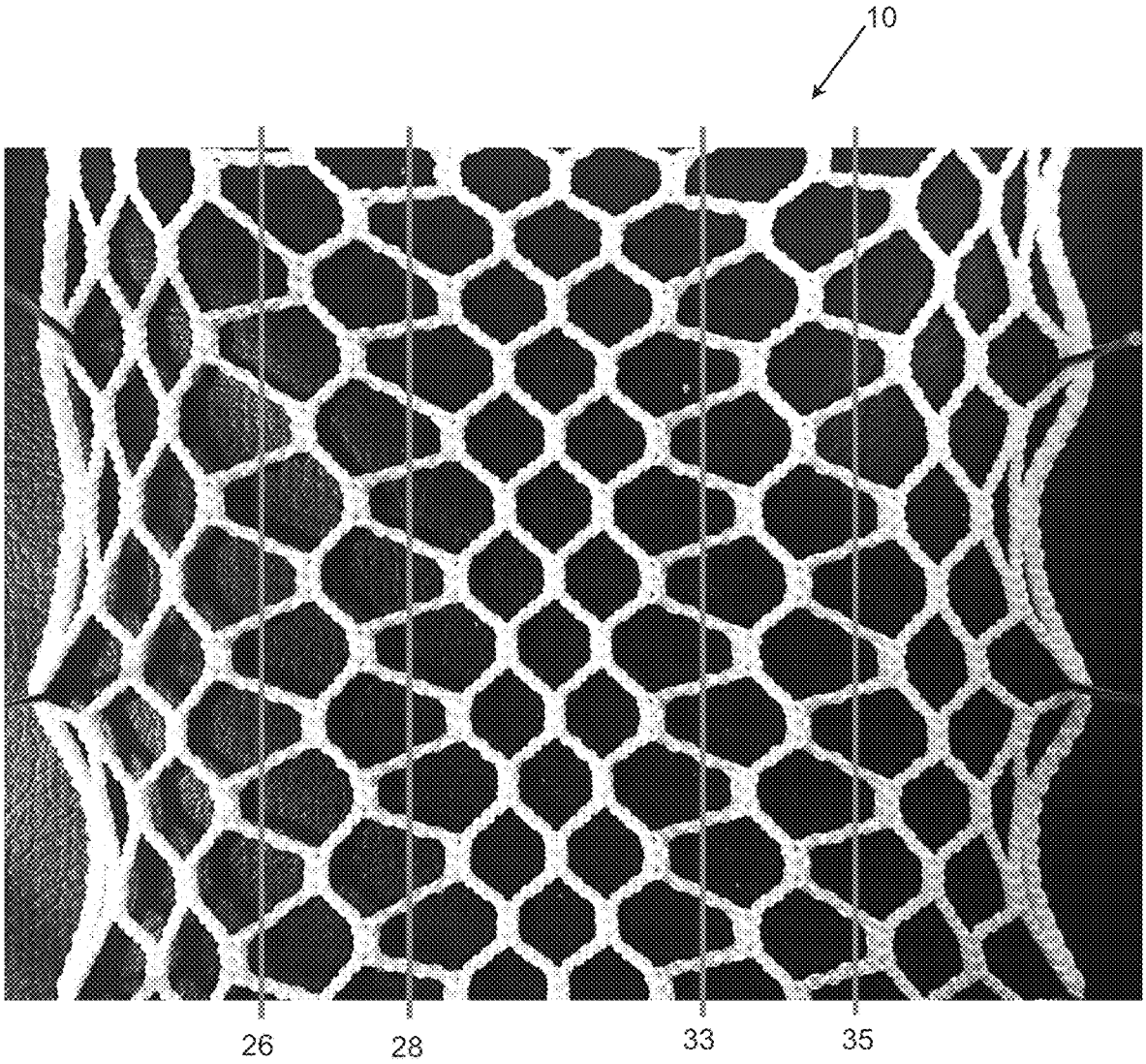
FIG. 2 is a close-up view of a lacrosse mesh with elastic portion(s), according to an embodiment.
Figure 3:
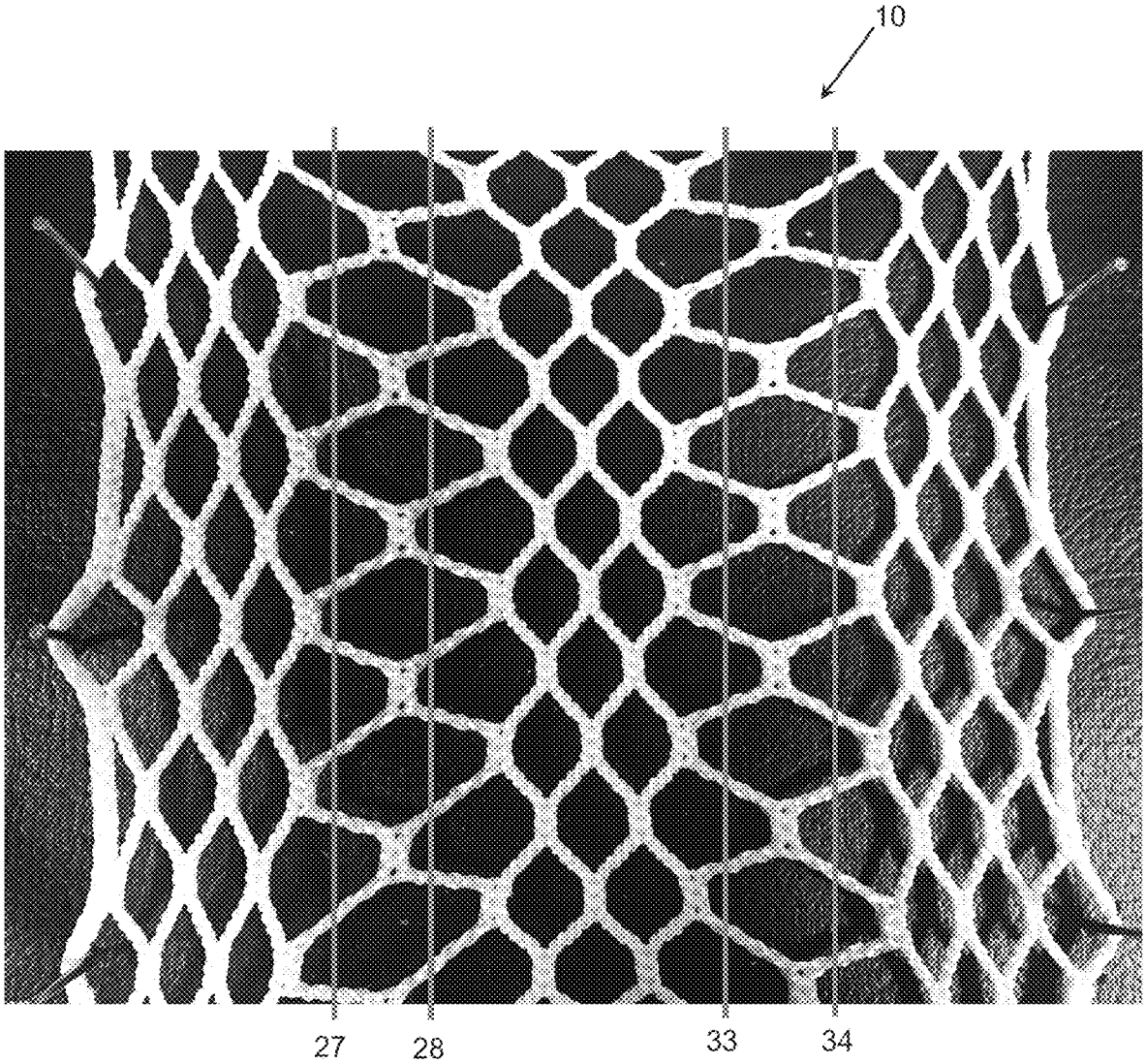
FIG. 3 is another close-up view of a lacrosse mesh with elastic portion(s), according to an embodiment.
Figure 4:
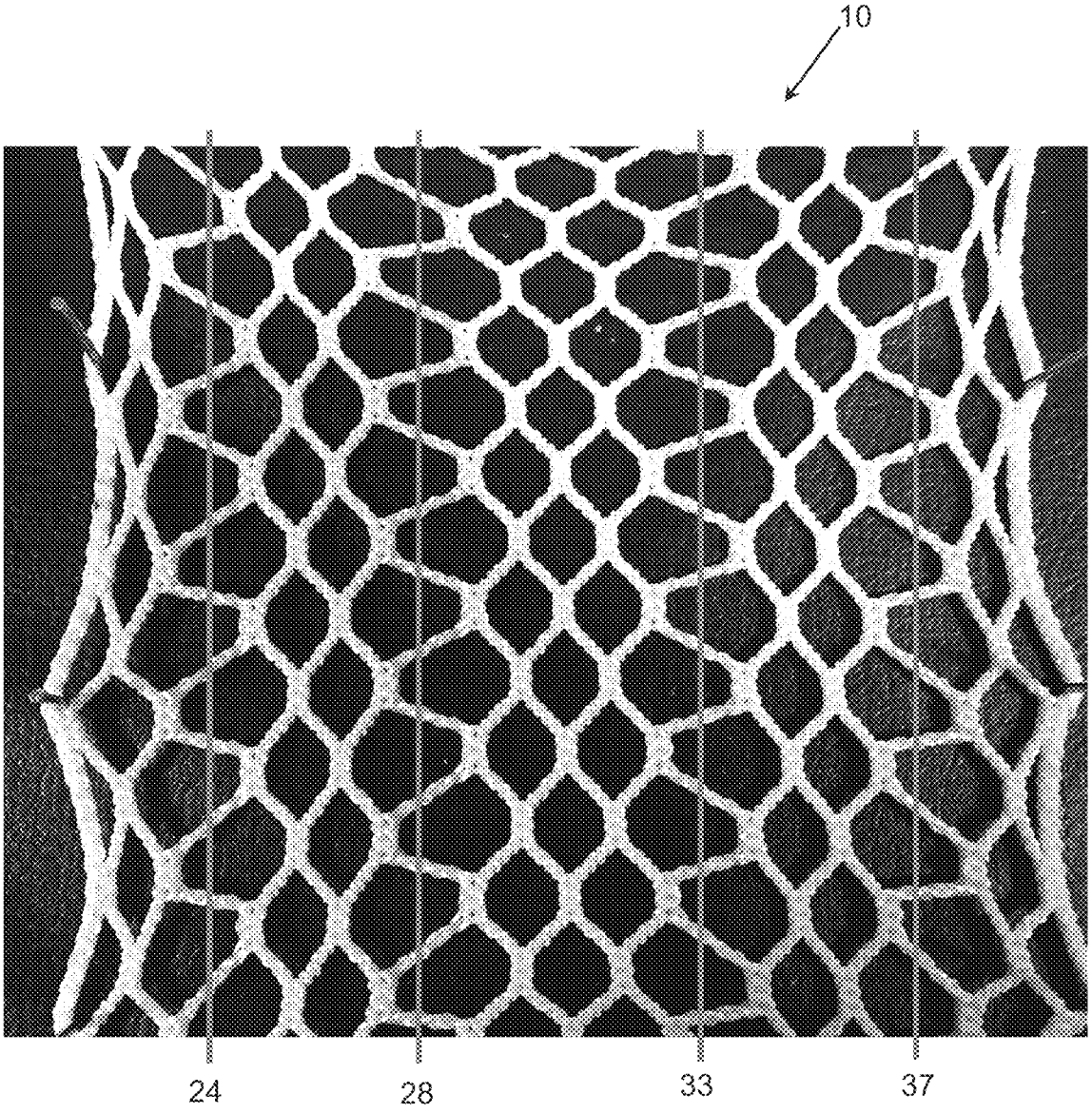
FIG. 4 is yet another close-up view of a lacrosse mesh with elastic portion(s), according to an embodiment.
Figure 5A:
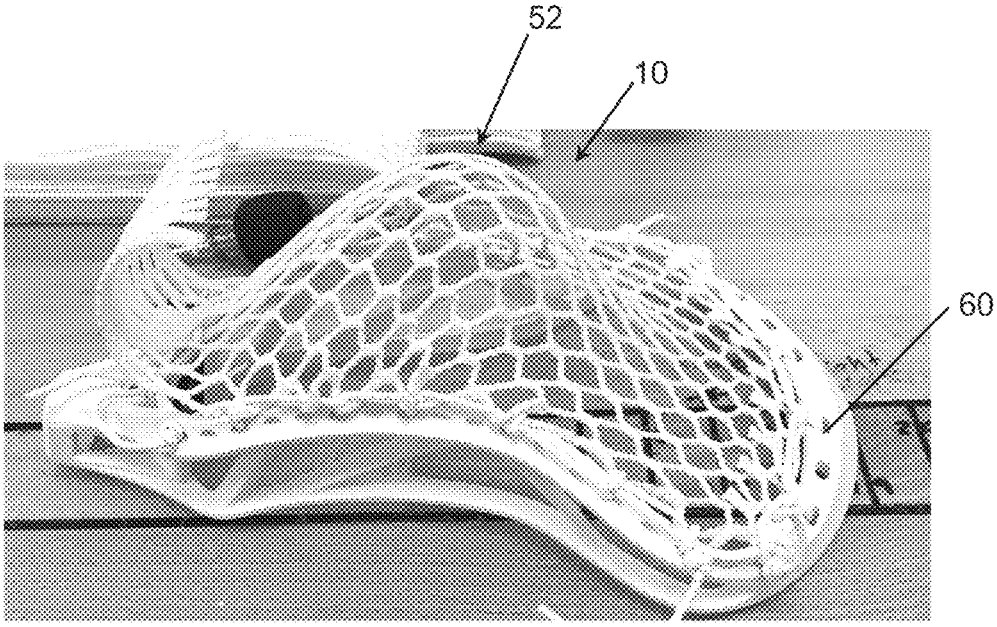
FIG. 5A is a perspective view of a lacrosse mesh coupled to a head in an original state, according to an embodiment.
Figure 5B:
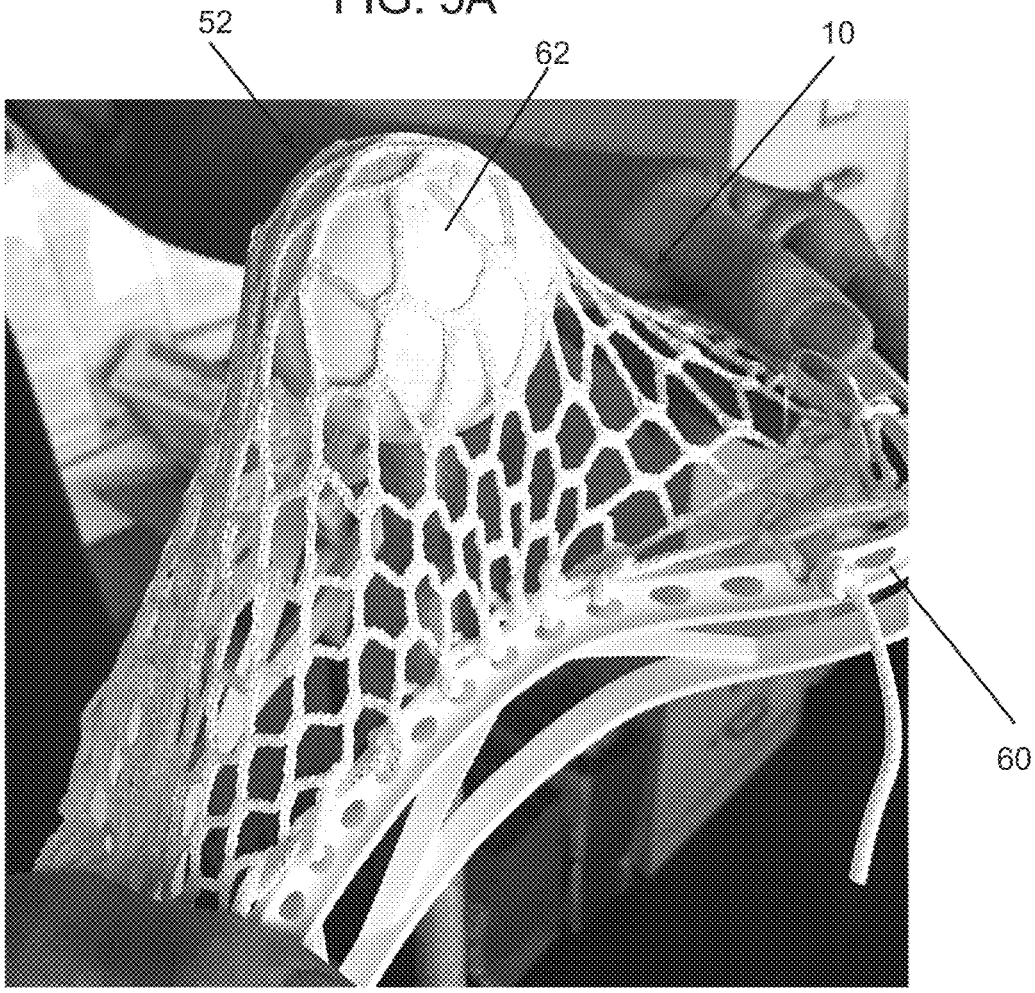
FIG. 5B is a perspective view of a lacrosse mesh coupled to a head with a ball expanding the lacrosse mesh, according to an embodiment.
Figure 5C:
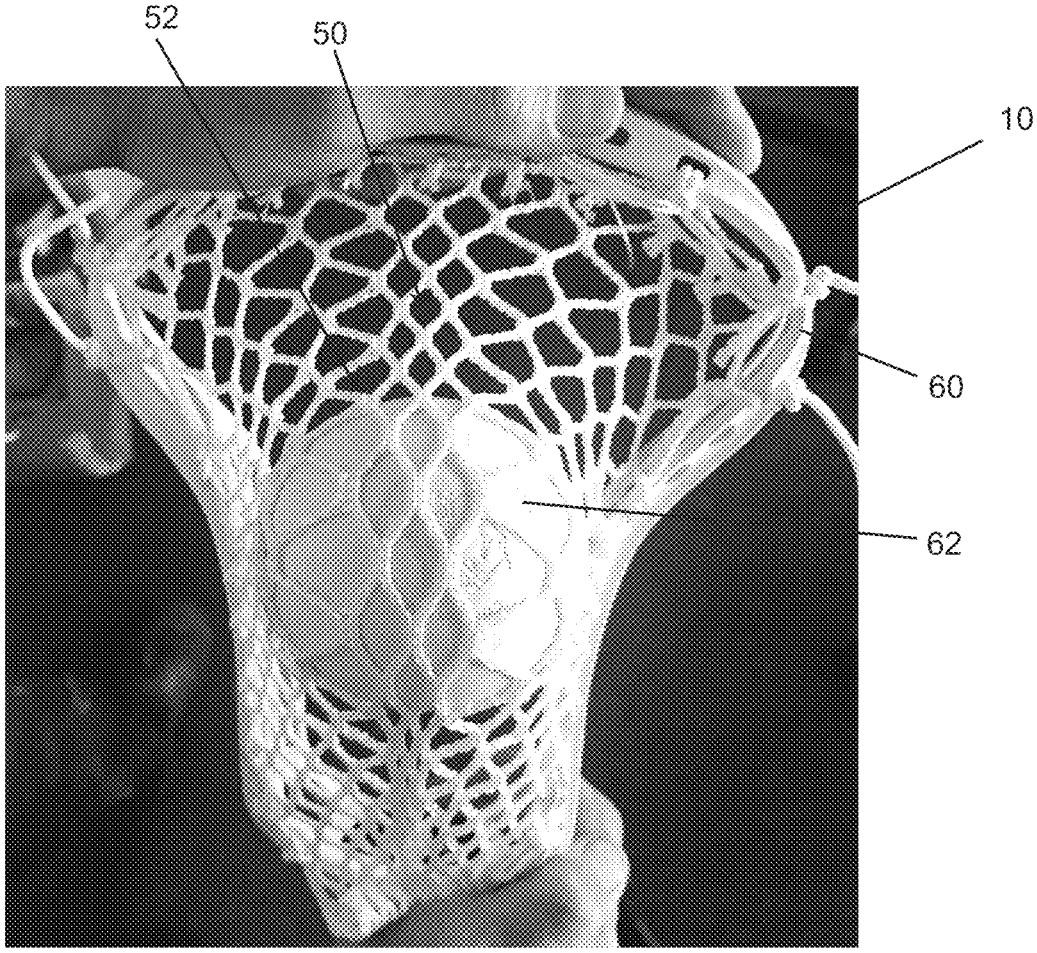
FIG. 5C is a rear view of a lacrosse mesh coupled to a head with a ball expanding the lacrosse mesh, according to an embodiment.
Figure 5D:
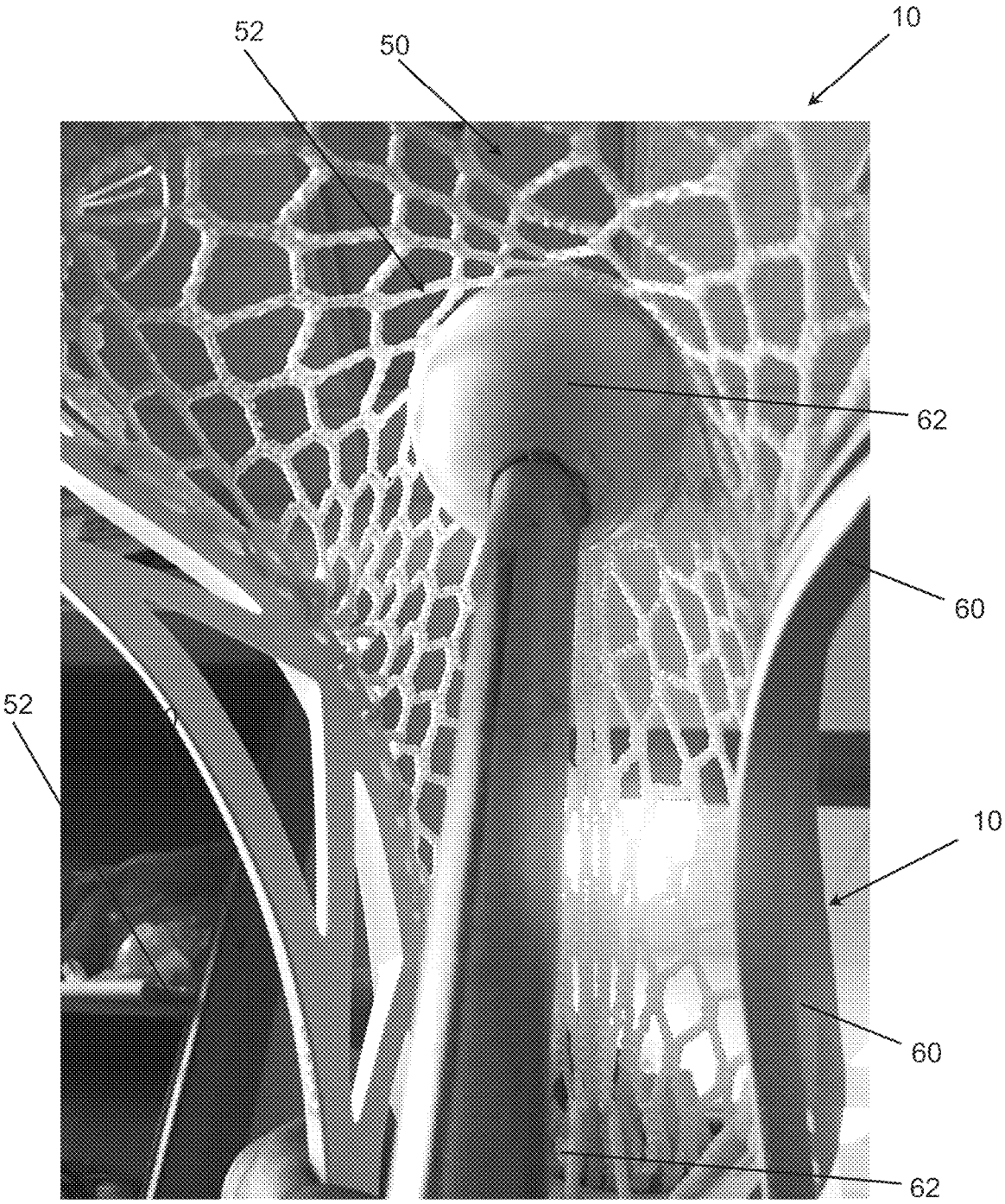
FIG. 5D is a front view of a lacrosse mesh coupled to a head with a ball expanding the lacrosse mesh, according to an embodiment.
Figure 5E:
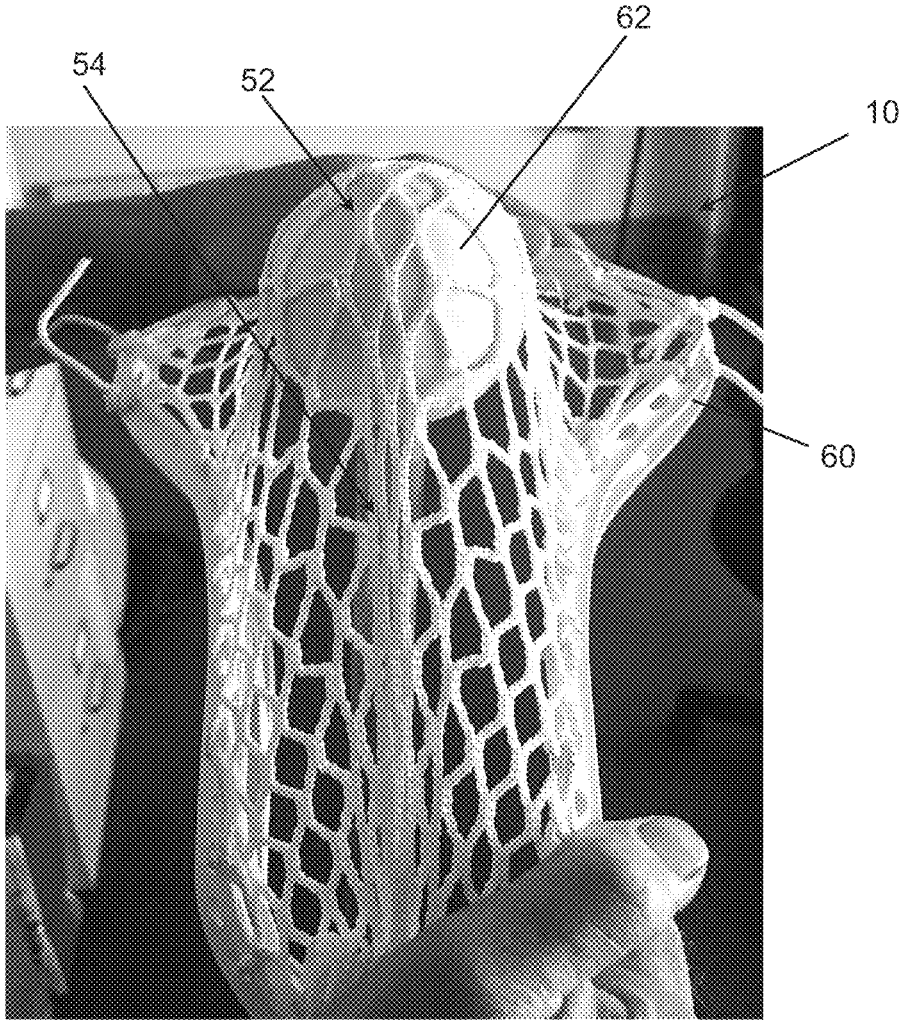
FIG. 5E is a bottom perspective view of a lacrosse mesh coupled to a head with a ball expanding the lacrosse mesh, according to an embodiment.
Figure 5F:
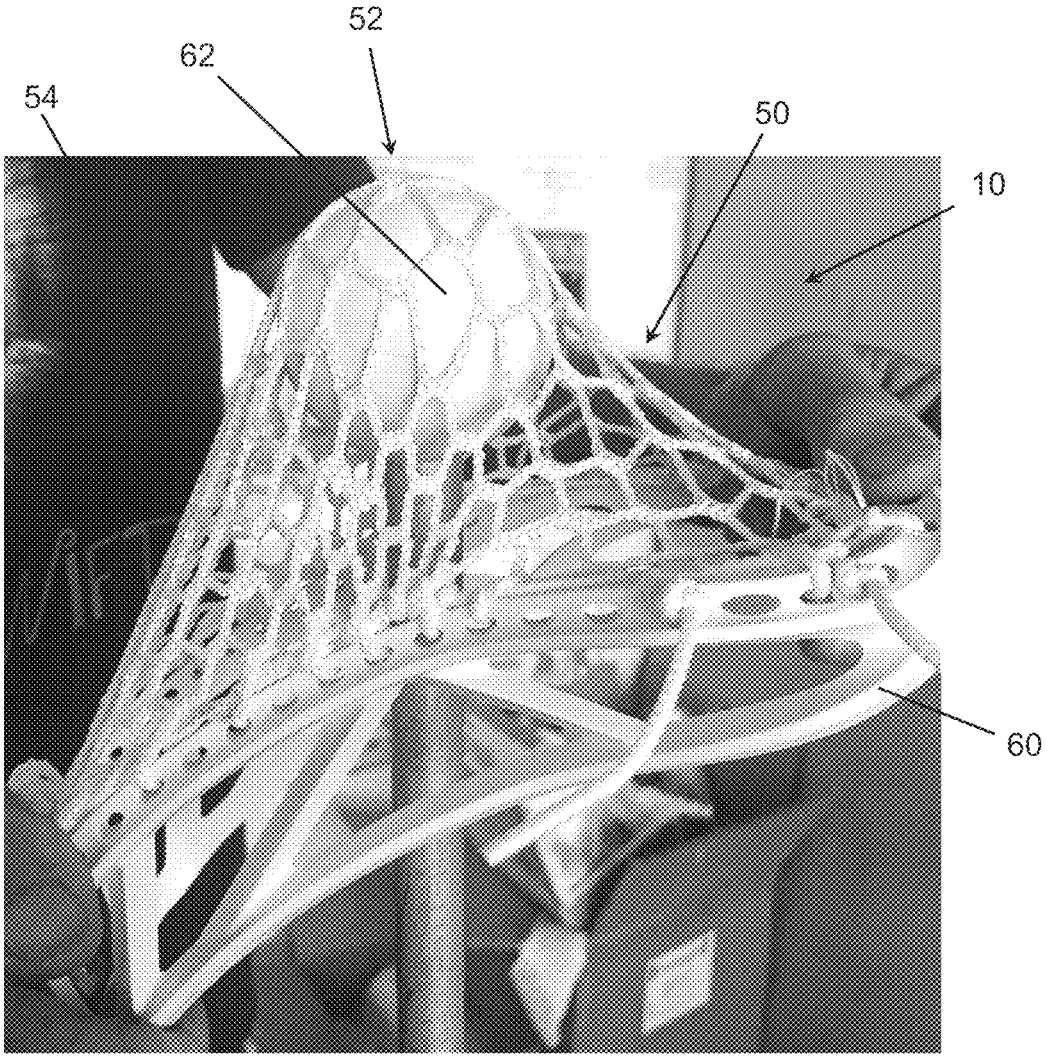
FIG. 5F is a side view of a lacrosse mesh coupled to a head with a ball expanding the lacrosse mesh, according to an embodiment.

Conventional lacrosse mesh has several inherent limitations. For example, and without limitation, conventional lacrosse mesh is relatively fixed in its ability to expand and further may be strung to a lacrosse head to locate a pocket in various locations, such as low, middle or high. The location of the pocket is fixed once the conventional lacrosse mesh is strung to the head. The lacrosse mesh results in the need for a player to exert a lot of energy and effort to throw the ball, the effort being directed mainly to maintaining the ball within the fixed pocket for as long as possible in order to create a repeatable and accurate throw, shot, pass or the like. Additionally, a deep pocket creates greater whip but has greater hold, while a shallow pocket has less whip with less hold. Players typically want greater hold with less whip, and conventional lacrosse mesh has difficulty providing this.

Embodiments of the present invention relate to a lacrosse mesh with elastic portion(s). For example, and without limitation, the mesh may be formed with elastomeric yarn along vertical paths for the length of the mesh. In some embodiments, the vertical paths along the length of the mesh having elastic portion(s) may be symmetrical about a center of the mesh, or in other embodiments may not be symmetrical. Further, embodiments of the present invention may be used with lacrosse mesh for all head types, including goalie heads, wherein the elastic portion(s) may be used with goalie mesh.

The lacrosse mesh with elastomeric portions includes a pocket that is constantly changing and the player is not limited to a fixed pocket. The lacrosse mesh, according to embodiments, expands as a ball traverses the lacrosse mesh, creating greater hold while reducing whip that is absorbed by the elastic portion(s). Hold is also increased because of increased grip of the elastic portion(s). Because of this, the more exertion that a player puts into a throw, the more hold it has, the whip is absorbed and the elastic portion(s) increases the speed of the ball. In at least these respects, the lacrosse mesh with elastomeric portions does not have diminishing returns, unlike conventional lacrosse mesh. This creates more versatility in the lacrosse mesh with elastomeric portions.

The player may make various types of throws or shots that are suited for various pocket locations because the lacrosse mesh with elastic portion(s) has variable pocket locations that are changed during play by the player making simple adjustments to the types of throws, wherein the pocket location changes do not require removing the lacrosse mesh and restringing it with the pocket in a different spot. The lacrosse mesh with elastomeric portions operates in a manner that allows the types of throws the player chooses during play. Further the lacrosse mesh has greater hold and resists being dislodged from the pocket by a stick check by expanding the lacrosse mesh and therefore the pocket in response to forced being applied to the stick during play resulting in better ball security.

Referring to the drawings, FIGS. 1-4 depict a lacrosse mesh 10 having elastic portion(s). The lacrosse mesh 10 may be formed with elastic portions along any portion of the lacrosse mesh 10, such as but not limited to, along vertical paths for the length of the lacrosse mesh 10, as shown in FIG. 1. The remaining portions may be formed with non-elastomeric properties. For example, in forming the lacrosse mesh 10, the lacrosse mesh may require categorizing each region that will form the length of the lacrosse mesh 10, such as vertical regions 21-40 of FIG. 1, wherein the vertical regions refer to a region along a line across the length of the lacrosse mesh 10. It will be understood that while FIG. 1 shows twenty different regions, other lacrosse mesh sizes may be formed into a lacrosse mesh 10. For example, lacrosse mesh 10 may have 10, 12, 14, 16, 18, 20, 24, 28, 34, or 40 different vertical regions, or any number of regions necessary for forming the lacrosse mesh 10. Material with elastic properties, such as but not limited to elastomeric yarn or other material with elastic properties, may be selected for use in one or more vertical regions 21-40. The lacrosse mesh 10 may be formed using a typical machine or other means of forming lacrosse mesh. In at least this way, the lacrosse mesh will then have the elastic portion(s) extending down the length of the lacrosse mesh within one or more of the vertical regions 21-40, and another type of non-elastomeric material extending down in the length of the lacrosse mesh 10 within the remaining vertical regions 21-40. It will also be understood that the elastic portions may be located in various portions of the lacrosse mesh 10, such as horizontally across the mesh, diagonally across the mesh and other orientations and locations of the lacrosse mesh 10. It will be understood that the elastic portions and the non-elastic portions operate together to provide the benefits attributed to the elastic properties while maintaining the integrity of the lacrosse mesh 10 through use of the non-elastic portions.

In some embodiments, the lacrosse mesh 10 may be formed with elastic portions of the lacrosse mesh 10 located along vertical paths for the length of the lacrosse mesh 10, as shown in FIG. 1. For example, the vertical paths or regions designated as 26, 28 and 33, 35 in FIG. 2 may be formed with elastic portion(s). In this particular embodiment, the vertical paths 26, 28 and 33, 35 along the length of the mesh 10 having elastic portion(s) may be symmetrical about a center of the mesh on either side of the center of the mesh 10, or may be used to form channel. In another example, the vertical paths or regions designated as 27, 28 and 33, 34 in FIG. 3 may be formed with elastic portion(s). In this particular embodiment, the vertical paths 27, 28 and 33, 34 along the length of the mesh 10 having elastic portion(s) may be symmetrical about a center of the mesh on either side of the center of the mesh 10, or may be used to form channel. In yet another example, the vertical paths or regions designated as 24, 28 and 33, 37 in FIG. 4 may be formed with elastic portion(s). In this particular embodiment, the vertical paths 24, 28 and 33, 37 along the length of the mesh 10 having elastic portion(s) may be symmetrical about a center of the mesh on either side of the center of the mesh 10, or may be used to form channel. In other embodiments, the vertical paths having elastic portion(s) may not be symmetrical. It will be understood that in some embodiments, various vertical paths and any number of vertical paths and any combination thereof along the length of the lacrosse mesh may be formed with elastic portion(s).

A pocket 52 with a corresponding channel 50 is shown located in lacrosse mesh 10 with elastic portion(s). With additional reference to FIGS. 5A-5F, the pocket 52 with the corresponding channel 50 is formed in response to receiving or throwing a ball from the lacrosse head 60 with the lacrosse mesh 10 strung to it. The pocket 52 and the channel 50 are each formed in response to the elastic portion(s) moving from an original state (see FIG. 4) to an expanded state (see FIG. 5) during receiving and/or throwing of the ball 62. Further, the pocket 52 and/or corresponding channel 50 absorbs the impact or otherwise reduces the impact of the ball 62 in response to receiving the thrown ball 62 within the pocket 52 and/or corresponding channel 50, reducing a need for an intuitive cradle movement. The pocket 52 retains the ball 62 in an original state. Further, the elastic portion(s) grips or provides increased friction between the lacrosse mesh 10 and the ball 62 within the pocket during play and further during a throwing motion, the ball 62 remains within the channel 50 through the throwing motion, thereby reducing lateral movement of the ball 62 during the throwing motion.

The pocket 52 and corresponding channel 50 returns from the expanded state (see FIG. 5) to the original state (See FIG. 4) during throwing as the ball 62 leaves a portion of the pocket 52 and corresponding channel 50, and wherein the return of the channel 50 increases the speed of the thrown ball above what the throwing motion creates with a standard lacrosse mesh provides. This occurs because the pocket 52 and associated channel 50 are live and active with the ability to stretch and recoil in order to absorb shock of the ball when receiving and accelerate the ball with additional compliant force when thrown. In other words, as the ball 62 displaces the lacrosse mesh 10 construction and passes through the channel 50 formed, resulting from the expansion and contraction of the lacrosse mesh 10, hold is intensified and the whip is absorbed in the wake 54 of the ball's 32 movement within the pocket 52 and/or channel 50, before release.

The throwing of a lacrosse ball from a lacrosse stick generally operates as a lever arm that can be used to generate large torque forces to throw the ball with great velocity and great distances. The elastomeric mesh adds another form of force to the large torque force. This additional force may be an elastic force that is added into the system of forces utilized to throw the lacrosse ball. The elastic force added to the torque force allows the ball 62 to be released or thrown at a velocity greater than the velocity generated from a standard non-lacrosse mesh coupled to the lacrosse head of the lacrosse stick using the same torque force. Players may now use less range of motion of the lacrosse stick (lever arm) with the elastomeric mesh to throw the ball at the velocity that would have required a larger range of motion or a greater acceleration of the lacrosse stick to obtain. This creates greater accuracy and velocity of throwing by reducing errors, such as errors generated by a large or big swinging or sweeping throwing motion.

When shooting, the pocket 52 with corresponding channel 50 of the lacrosse mesh 10 strung in the lacrosse head 60 operates to improve feel, playability and accuracy. Because pocket 52 and the corresponding channel 50 have increased grip due to the use of the elastic portion(s), lateral movement of the ball within the lacrosse mesh 10 is reduced during a throwing/shooting motion; thereby creating consistent release of the ball from the lacrosse mesh 10.

The above description of lacrosse mesh 10 with elastic portion(s) and the figures are presented by way of example only and are not a limitation to the invention. For example, and without limitation, the elastic portion(s) may be used with lacrosse mesh that has the same mesh sizes, lacrosse mesh with multiple mesh sizes and any type of lacrosse mesh.

Figure 6:
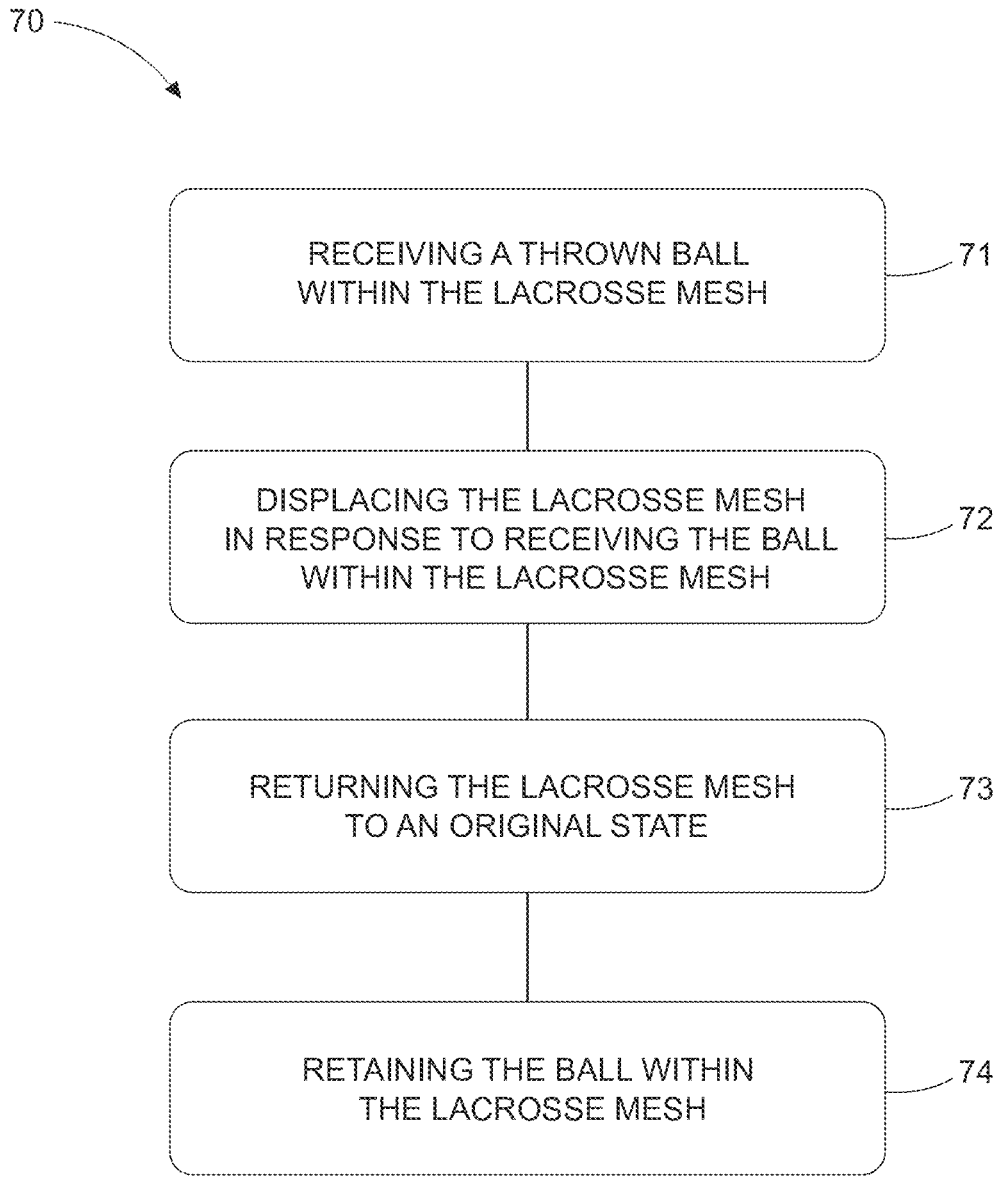
FIG. 6 is flow chart of a method of using a lacrosse mesh with elastic portion(s), according to an embodiment.

Referring to FIG. 6, an embodiment includes a method 70 of using and elastomeric mesh configuration strung to a lacrosse head. The method 70 includes receiving a thrown ball within the lacrosse mesh (Step 71); displacing the lacrosse mesh in response to receiving the ball within the lacrosse mesh, wherein displacing the lacrosse mesh includes expanding the lacrosse mesh to an expanded state (Step 72); returning the lacrosse mesh to an original state (Step 73); and retaining the ball within the lacrosse mesh (Step 74).

The method 70 may include additional steps. For example, Step 72 of displacing the lacrosse mesh may comprise expanding the lacrosse mesh at locations in the lacrosse mesh having elastic portion(s). Step 72 of displacing the lacrosse mesh may also comprise absorbing an impact of the ball within the lacrosse mesh. Step 71 of receiving the thrown ball includes receiving the thrown ball within the lacrosse mesh without performing a cradling motion. Returning the lacrosse mesh to an original state of Step 73 may include returning expanded elastic portion(s) within the lacrosse mesh to a condition prior to expanding. Step 72 of displacing the lacrosse mesh includes expanding the lacrosse mesh at the point of entry of the ball within the lacrosse mesh to form a pocket at the point of entry.

Figure 7:
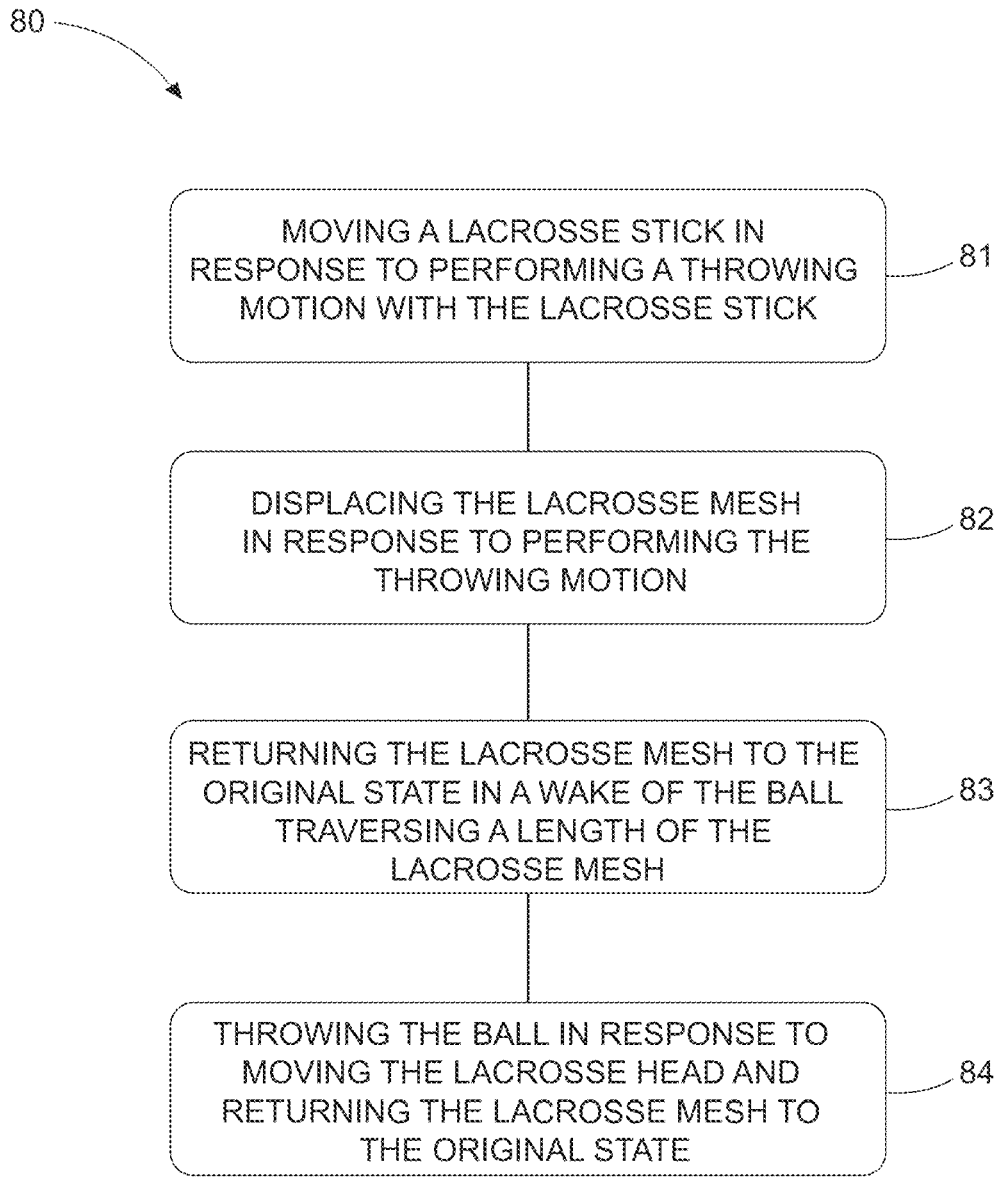
FIG. 7 is a flow chart of another method of using a lacrosse mesh with elastic portion(s), according to an embodiment.

Referring to FIG. 7, an embodiment includes a method 80 of using an elastomeric lacrosse mesh configuration strung to a lacrosse head. The method 80 includes moving a lacrosse stick having a lacrosse head with the lacrosse mesh coupled to it in response to performing a throwing motion with the lacrosse stick, wherein a ball is within the lacrosse mesh in an original state (Step 81); displacing the lacrosse mesh in response to performing the throwing motion, wherein displacing the lacrosse mesh includes expanding the lacrosse mesh (Step 82); returning the lacrosse mesh to the original state in a wake of the ball traversing a length of the lacrosse mesh (Step 83); and throwing the ball in response to moving the lacrosse head and returning the lacrosse mesh to the original state in the wake of the ball traversing the length of the lacrosse mesh, wherein the ball is thrown with greater velocity than a velocity created from a conventional lacrosse mesh with the same throwing motion (Step 84).

The method 80 may include additional steps. For example, Step 81 of displacing the lacrosse mesh comprises expanding the lacrosse mesh at locations in the lacrosse mesh having elastic portion(s). Returning the lacrosse mesh to an original state of Step 82 may comprise returning expanded elastic portion(s) within the lacrosse mesh to a condition prior to being expanded.

The method 80 may further comprise moving the ball along a channel dynamically formed in response to displacing the lacrosse mesh. In the method 80, the channel is dynamically formed in response to the ball traversing along a length of the lacrosse mesh when performing the throwing motion, wherein the ball displaces the lacrosse mesh along the length of the lacrosse mesh as the ball traverses the lacrosse mesh. The method 80 may also include gripping the ball with elastic portion(s) of the lacrosse mesh. The method

80 may further include minimizing whip, increasing hold and improving throwing control in response to returning the lacrosse mesh to the original state in the wake of the ball traversing the length of the lacrosse mesh.

In some embodiments and in the course of playing lacrosse, a method may include a combination of methods 70 and 80. For example and without limitation, the method may include receiving a thrown ball within the lacrosse mesh in an original state; displacing the lacrosse mesh in response to receiving the ball within the lacrosse mesh, wherein displacing the lacrosse mesh includes expanding the lacrosse mesh at the point of entry of the ball within the lacrosse mesh to form a pocket at the point of entry; returning the lacrosse mesh to an original state; retaining the ball within the lacrosse mesh; moving a lacrosse stick having a lacrosse head with the lacrosse mesh coupled to it in response to performing a throwing motion with the lacrosse stick, wherein a ball is within the lacrosse mesh in an original state; displacing the lacrosse mesh in response to performing the throwing motion, wherein displacing the lacrosse mesh includes expanding the lacrosse mesh; returning the lacrosse mesh to the original state in a wake of the ball traversing a length of the lacrosse mesh; minimizing whip, increasing hold and improving throwing control in response to returning the lacrosse mesh to the original state in the wake of the ball traversing the length of the lacrosse mesh; and throwing the ball in response to moving the lacrosse head and returning the lacrosse mesh to the original state in the wake of the ball traversing the length of the lacrosse mesh, wherein the ball is thrown with greater velocity than a velocity created from a conventional lacrosse mesh with the same throwing motion.

This combination of method 70 of receiving a thrown ball and method 80 of throwing a ball by a player enhances the play because of the lacrosse mesh 10 with elastic portions. In use, the pocket is formed as the ball initially enters the lacrosse mesh 10, thereby displacing and expanding the lacrosse mesh at a point of entry to form a pocket. The player has the option to cradle the ball, pass the ball or shoot the ball once it has been received. The player may move the lacrosse stick in a throwing motion to pass or shoot the ball. In performing the throwing motion, the ball traverses the lacrosse mesh 10 moving from the pocket 52 and through the corresponding channel 50 until the point of release. As the ball traverses the pocket 52 and corresponding mesh channel 50, the lacrosse mesh returns to its original state in the wake of the ball traversing the lacrosse mesh 10, thereby minimizing whip, increasing hold and improving passing or shooting control. Whip is a common term in lacrosse that refers to the aftershock reaction of the lacrosse mesh initiated at the ball's point of release. As a general rule, less whip results in more control in passing or shooting the ball. The lacrosse mesh 10 with elastic portions has virtually no whip or minimal whip compared with traditional lacrosse mesh, while maintaining increased hold over traditional mesh that has comparable minimal whip.

Forming the lacrosse mesh 10 with elastomeric portions includes using non-elastomeric yarn and elastomeric yarn on a knitting machine, such as, but not limited to a multibar Raschel knitting machine. The non-elastomeric yarn may be loaded on beams under tension or warped onto the beams and the non-elastomeric yarn warped beams are then placed on shafts of the knitting machine in the proper locations for use with stitching bars and layin bars. Multiple non-elastomeric warped beams may be used for both the stitching bars and layin bars of the multibar Raschel knitting machine. The elastomeric yarn is then supplied from an original bobbin or other free flowing source of elastomeric yarn (not preloaded with tension). The elastomeric yarn may be fed through guides and wrapped around the non-elastomeric yarn warped beams a predetermined number of times, such as, but not limited to three times. The elastomeric yarn is then threaded through the respective guides of the stitching bars and the layin bars depending on where the intended location of the elastomeric yarn is to be knitted in the pattern of the lacrosse mesh. The non-elastomeric yarn becomes a companion yarn to the elastomeric yarn and during operation of the multibar Raschel knitting machine, the elastomeric yarn and the non-elastomeric yarn are drawn into the knitting machine and the tension of the elastomeric yarn is self-adjusted to match the tension of the non-elastomeric yarn on the warped beam because of the wrapping of the elastomeric yarn around the non-elastomeric yarn warped beam. This synchronizes the tension in the yarns to allow the lacrosse mesh to be stitched with non-elastomeric yarn and elastomeric yarn simultaneously as companion yarns.

As described above, during operation, the drawing of the elastomeric yarn and non-elastomeric yarn through the guides and the respective stitching bar and the layin bar self-adjusts the tension of the elastomeric yarn in order synchronize the tension of the non-elastomeric yarn and the elastomeric yarn. The self-adjustment of the tension is continuous, wherein the tension is self-adjusted to be maintain synchronized tension between the elastomeric yarn and the non-elastomeric yarn as the amount of non-elastomeric yarn is reduced on the warped beam during stitching operations. This self-adjusting tension of the elastomeric yarn allows the non-elastomeric yarn under pretension on the beam to be knitted simultaneously with and to the elastomeric yarn that is not under pretension. This configuration makes it possible to form the lacrosse mesh 10 with elastomeric portions as discussed above and for the same to be formed in a synchronized and simultaneous knitting process. Further, in some embodiments, the lacrosse mesh may be directed through three post knitting tension bars to control tension on the finishing end of knitting the lacrosse mesh 10.

Referring again to FIGS. 1-4 the lacrosse mesh 10 having elastomeric portion(s) formed using the synchronized stitching and self-adjusting tension method described above. The lacrosse mesh 10 may be formed with elastomeric yarn along any portion of the lacrosse mesh 10, such as but not limited to, along vertical paths for the length of the lacrosse mesh 10, as shown in FIG. 1. The remaining portions may be formed with non-elastomeric yarn. For example, in forming the lacrosse mesh 10, the lacrosse mesh may require categorizing each region that will form the length of the lacrosse mesh 10, such as vertical regions 21-40 of FIG. 1, wherein the vertical regions refer to a region along a line across the length of the lacrosse mesh 10. It will be understood that while FIG. 1 shows twenty different regions, other lacrosse mesh sizes may be formed into a lacrosse mesh 10. For example, lacrosse mesh 10 may have 10, 12, 14, 16, 18, 20, 24, 28, 34, or 40 different vertical regions, or any number of regions necessary for forming the lacrosse mesh 10.

The lacrosse mesh will then have the elastomeric portion (s) extending down the length of the lacrosse mesh within one or more of the vertical regions 21-40, and another type of non-elastomeric material extending down the length of the lacrosse mesh 10 within the remaining vertical regions 21-40, such that at crossovers 100 between a vertical region of elastomeric yarn and non-elastomeric yarn are stitched together using the synchronized, self-adjusting tension method described above.

Figure 8:
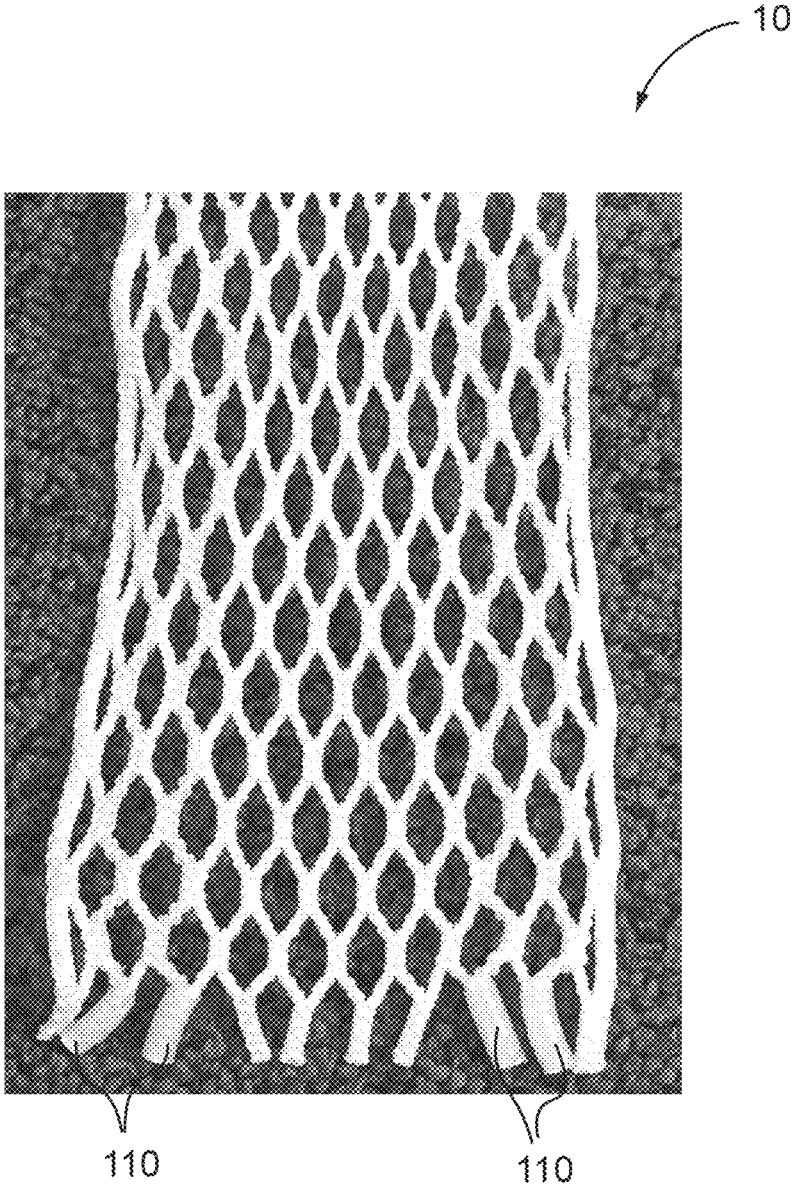
FIG. 8 is a front view of lacrosse mesh with elastic portions and securing members on the ends, according to an embodiment.

In forming the lacrosse mesh 10, cuts are made to the stitched mesh and heat is typically applied to secure ends of non-elastomeric yarn from fraying or otherwise coming apart. Elastomeric yarn does not have the material characteristics to respond to such techniques of resisting fraying. In embodiments, as shown in FIG. 8 the lacrosse mesh 10 may include securing members 110 coupled to the lacrosse mesh 10 at ends having at least a portion of elastomeric yarn stitched therein. The securing member 110 operates to secure the elastomeric yarn together in the stitched condition. In some embodiments, the securing member 110 may be a clip that clips on ends of the lacrosse mesh 10 to prevent the unraveling or fraying of the elastomeric yarn stitched in lacrosse mesh 10.

In another embodiment, the securing member 110 may be a heat-shrink securing member. The heat-shrink securing member 110 may include using a portion of a tube of heat-shrink material placed over an end of the lacrosse mesh 10 with elastomeric yarn and applying heat to the heat-shrink securing member 110 in order to shrink the tube of material onto the end of the lacrosse mesh and thereby prevent the unraveling or fraying of the end of the lacrosse mesh 10 with elastomeric yarn therein. For example, and without limitation, heat shrink securing member may be heat shrink material formed of a dual wall, flexible, heat shrinkable polyolefin with an adhesive lining. When the heat shrink securing member is heated, the outer wall quickly shrinks while the adhesive liner melts and flows to form a watertight barrier. The heat shrink material forming the securing member 110 may shrink at 110 degrees Celsius, have a shrink ratio of 3:1, flame retardant, flexible, and adheres to a wide variety of substrates.

In embodiments, the elastic portions of the lacrosse mesh 10 may have a stretch factor at least two times the stretch factor of the non-elastomeric mesh after being knitted to form the lacrosse mesh 10. In other embodiments, the elastic portions of the lacrosse mesh 10 may have a stretch factor at least three times the stretch factor of the non-elastomeric mesh after being knitted to form the lacrosse mesh 10. In other embodiments, the elastic portions of the lacrosse mesh 10 may have a stretch factor at least four times the stretch factor of the non-elastomeric mesh after being knitted to form the lacrosse mesh 10. In other embodiments, the elastic portions of the lacrosse mesh 10 may have a stretch factor at least five times the stretch factor of the non-elastomeric mesh after being knitted to form the lacrosse mesh 10.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A method of forming lacrosse mesh comprising:

placing multiple polyester yarn warped beams on shafts of a knitting machine in locations for use with stitching bars and layin bars;

supplying elastomeric yarn from two free flowing sources not preloaded with tension;

feeding the elastomeric yarn from the two free flowing sources and wrapped around two different polyester yarn warped beams a predetermined number of times;

threading the elastomeric yarn different guides of the stitching bars and the layin bars corresponding to intended locations the elastomeric yarn is to be knitted in a pattern of a lacrosse mesh;

knitting the lacrosse mesh to form the lacrosse mesh with a plurality of vertical paths extending along an entire length of the lacrosse mesh with two vertical paths of the plurality of vertical paths formed of the elastomeric yarn and the remainder of the plurality of vertical paths formed of the polyester yarn extending the entire length of the lacrosse mesh, wherein the two vertical paths of elastomeric yarn are symmetrical about a center of the lacrosse mesh;

automatically self-adjusting tension of the elastomeric yarn to synchronize with the tension of the polyester yarn during knitting in response to operating the knitting machine with the elastomeric yarn wrapped around the polyester yarn warped beams to knit the polyester yarn and the elastomeric yarn simultaneously as companion yarns; and coupling heat-shrink securing members to the lacrosse mesh at ends of the at least two vertical paths formed of the elastomeric yarn.

* * * * *